US006721968B2

(12) United States Patent
Tolleson

(10) Patent No.: US 6,721,968 B2
(45) Date of Patent: Apr. 20, 2004

(54) BED FRAME ASSEMBLY

(76) Inventor: Thomas D. Tolleson, 3007 Stetson La., Houston, TX (US) 77043

( * ) Notice: Subject to any disclaimer, the term of this patent is extended or adjusted under 35 U.S.C. 154(b) by 0 days.

(21) Appl. No.: 10/190,160

(22) Filed: Jul. 5, 2002

(65) Prior Publication Data

US 2004/0003462 A1 Jan. 8, 2004

(51) Int. Cl.[7] ..... A47C 19/00
(52) U.S. Cl. ..... 5/2.1; 5/8; 5/9.1
(58) Field of Search ..... 5/2.1, 3, 8, 9.1

(56) References Cited

U.S. PATENT DOCUMENTS 3,722,205 A * 3/1973 Meyer ..... 5/8
3,952,342 A 4/1976 Hart
4,253,204 A 3/1981 Tasaka
4,312,086 A 1/1982 Bianco
D281,474 S * 11/1985 Moorkens ..... D6/384
5,003,650 A * 4/1991 Caya ..... 5/9.1
5,480,680 A * 1/1996 Vieyra ..... 427/388.4
6,560,792 B2 * 5/2003 Rosenquist ..... 5/9.1

* cited by examiner

*Primary Examiner*—Teri Pham Luu
*Assistant Examiner*—Fredrick Conley
(74) *Attorney, Agent, or Firm*—Kenneth P. Beyers

(57) ABSTRACT

A combination bed and desk frame includes an extended height headboard and footboard connected at the top of the footboard by two spaced sideboards. Cross members are fastened between the headboard corner posts and footboard corner posts near their bottoms. A lower pair of bed rails are fastened between the cross members for supporting a commercially available household door, forming a desk top. A horizontally disposed shelf is provided at the top of the headboard for supporting a lamp or other articles. A horizontally disposed dressing bench is provided on the footboard. The bed/desk frame can be adapted to accommodate commercially available mattresses and box springs of various widths.

6 Claims, 5 Drawing Sheets

BED FRAME ASSEMBLY

CROSS-REFERENCE TO RELATED APPLICATIONS

Not applicable.

STATEMENT REGARDING FEDERALLY SPONSORED RESEARCH AND DEVELOPMENT

Not applicable.

BACKGROUND OF THE INVENTION

1. Field of the Invention

The present invention generally relates to bedroom and household furniture and, more particularly, is concerned with a functional bed frame that may support a large desk beneath its bed portion.

2. Description of the Prior Art

Various types of beds or bed frames combined with a table, desk, or other furniture are disclosed by U.S. Pat. No. 3,952,342 to James Hart, U.S. Pat. No. 4,253,204 to Makoto Tasaka, and U.S. Pat. No. 4,312,086 to Bianco. However, a need still exists for a simple, easily assembled bed frame that is capable of supporting a large desk surface and a bed in a stacked arrangement. A need also exists for a simple and inexpensive bed frame that provides a shelf at its head and a dressing bench at its foot. Preferably, the bed frame that meets this need will accept mattresses and box springs of varying widths.

BRIEF SUMMARY OF THE INVENTION

The present invention addresses the aforementioned needs. According to one embodiment of the invention, a bed frame comprises a pair of spaced sideboards. The sideboards have first and second opposite ends. A bed rail is attached to one side of each sideboard. A headboard is attached to the first ends of the sideboards. The headboard has a horizontally disposed shelf thereon. A footboard is attached to the second ends of the sideboards. The footboard has a horizontally disposed dressing bench thereon.

According to a second embodiment of the invention, a bed and desk frame comprises a pair of spaced sideboards. The sideboards have first and second opposite ends. A headboard is attached to the first ends of the sideboards. A footboard attached to the second ends of the sideboards. A desk extends between the headboard and the footboard.

According to a third embodiment of the invention, a bunk bed frame comprises a pair of upper sideboards. The upper sideboards have first and second opposite ends. A pair of lower sideboards is spaced from and below the upper sideboards. The lower sideboards have first and second opposite ends. A headboard is attached to the first ends of the sideboards. The headboard has a horizontally disposed shelf thereon. A footboard is attached to the second ends of the sideboards.

BRIEF DESCRIPTION OF THE SEVERAL VIEWS OF THE DRAWINGS

For a more complete understanding of the present invention, and the advantages thereof reference is now made to the following Detailed Description of the Invention, taken in conjunction with the accompanying drawings, in which.

DETAILED DESCRIPTION OF THE INVENTION

Figure 1:
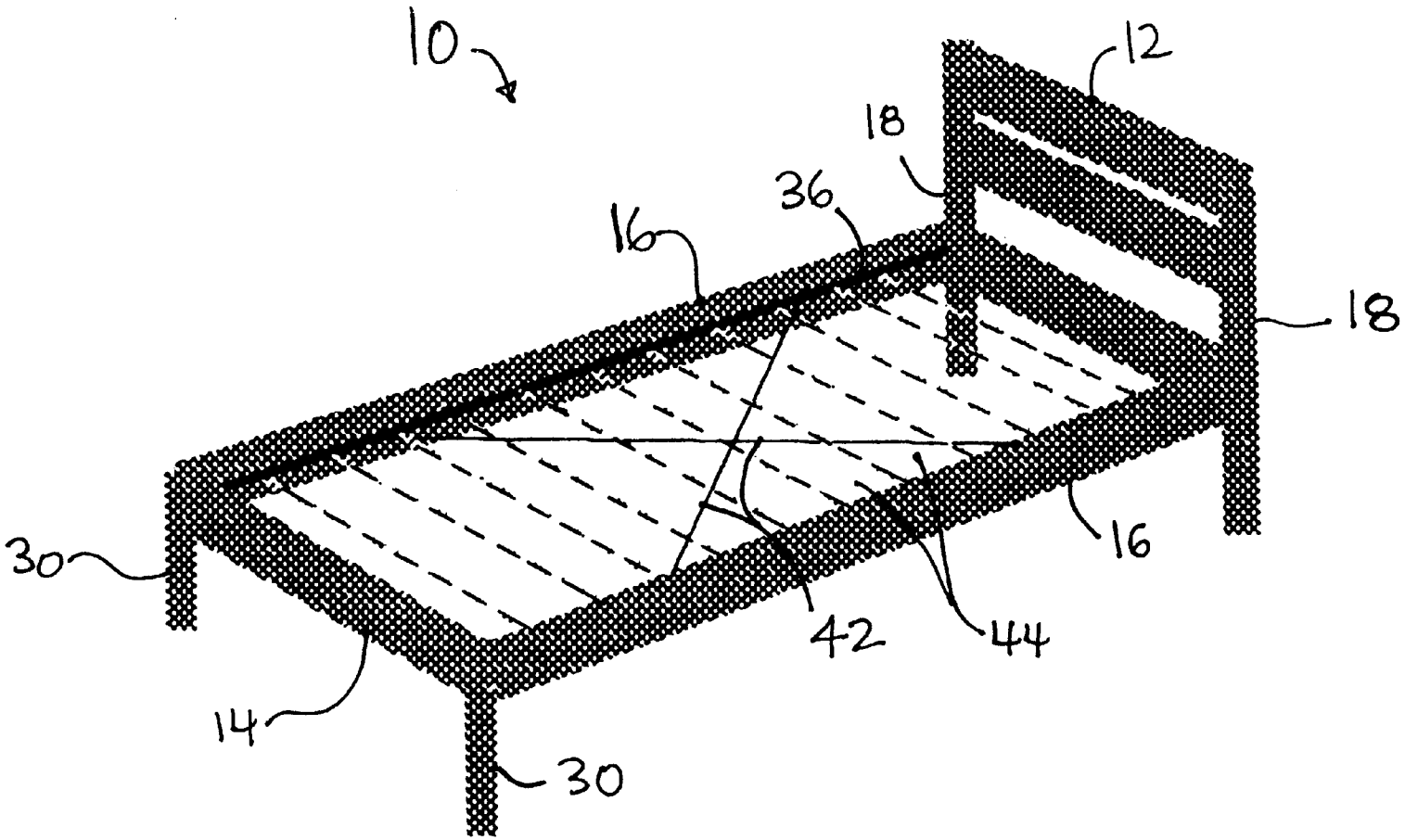
FIG. 1 is a perspective view of a twin size bed frame of the present invention.

The invention and its advantages are best understood by referring to the drawings, like numerals being used for like and corresponding parts of the various drawings.

In FIG. 1 there is shown in perspective view a twin size bed frame, generally designated 10, of the present invention. Bed frame 10 includes headboard 12, footboard 14, and two sideboards 16.

Figure 2B:
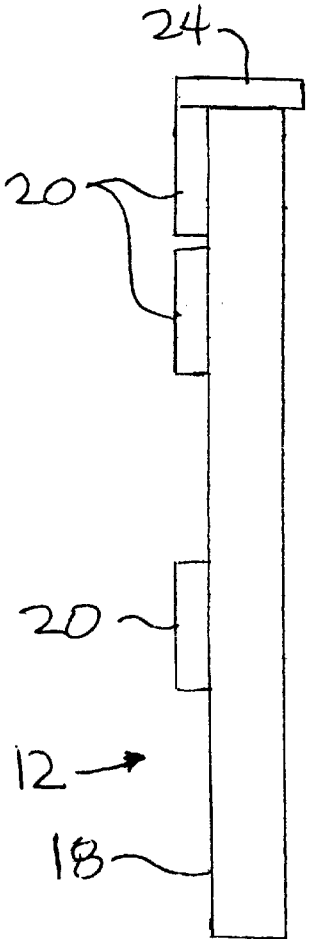
FIG. 2B is a side or end elevation view of the headboard of FIG. 2A.
Figure 2A:
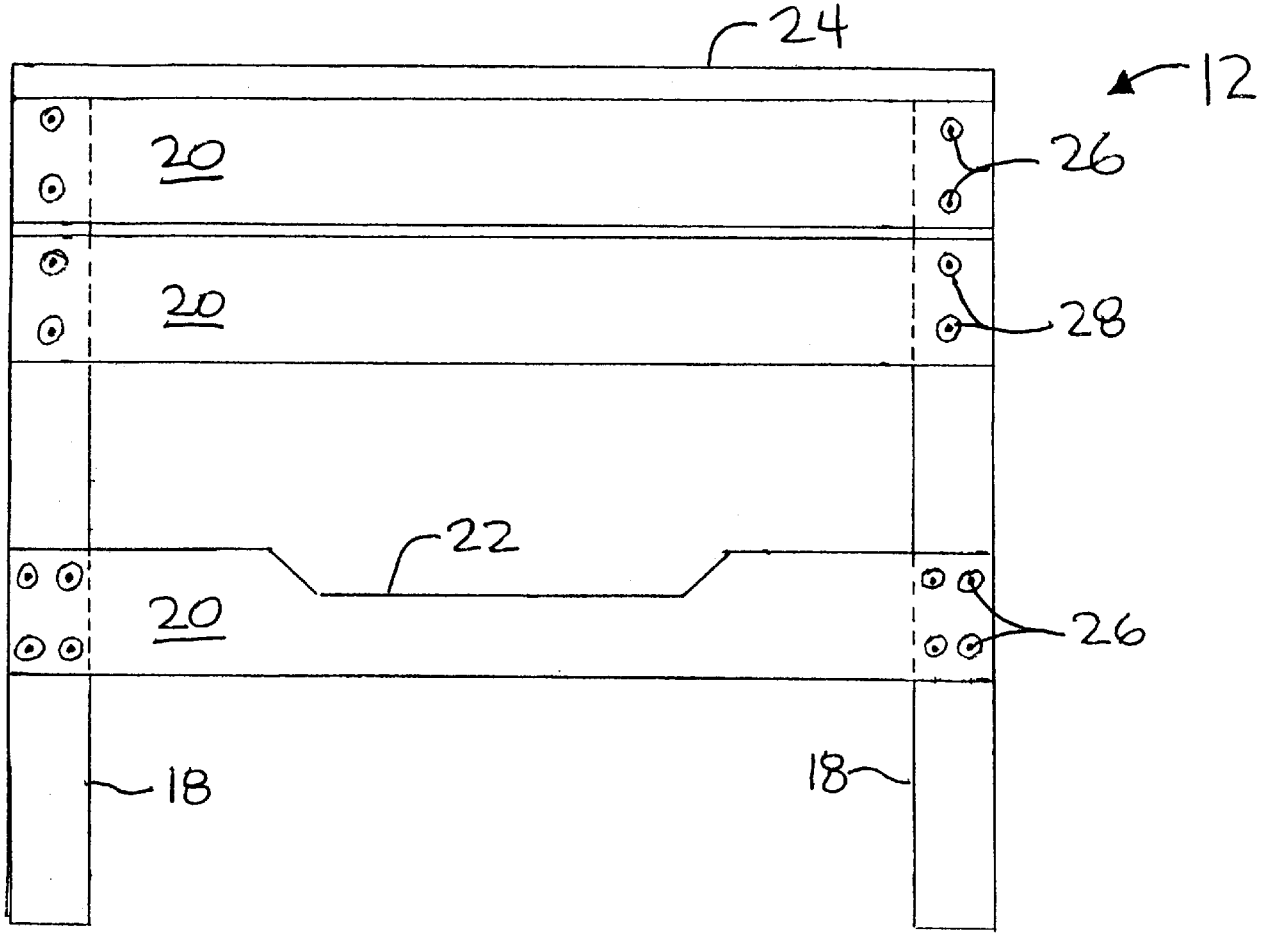
FIG. 2A is a front elevation view of the headboard of the bed frame of FIG. 1

Headboard 12 is seen in front elevation view in FIG. 2A and in side view in FIG. 2B. As seen in FIG. 2A, headboard 12 includes two spaced headboard corner posts 18. Corner posts 18 are connected by three headboard cross members 20. In the illustrated embodiment, lowermost cross member 20 includes a notch 22 at its center to accommodate an air mattress motor, water bed control, or similar apparatus (not illustrated). The top of headboard 12 is advantageously provided with a horizontally disposed shelf 24 for supporting a bed lamp, a potted plant, books, bedroom decorations, or the like (not illustrated). Headboard cross members 20 are fastened to corner posts 18 by bolts 26. Holes 28 in cross members 20 are recessed for receiving the nuts on bolts 26, thus providing a flush surface to headboard 12 when assembled.

Figures 3A, 3B, 4A, 4B, 4C:
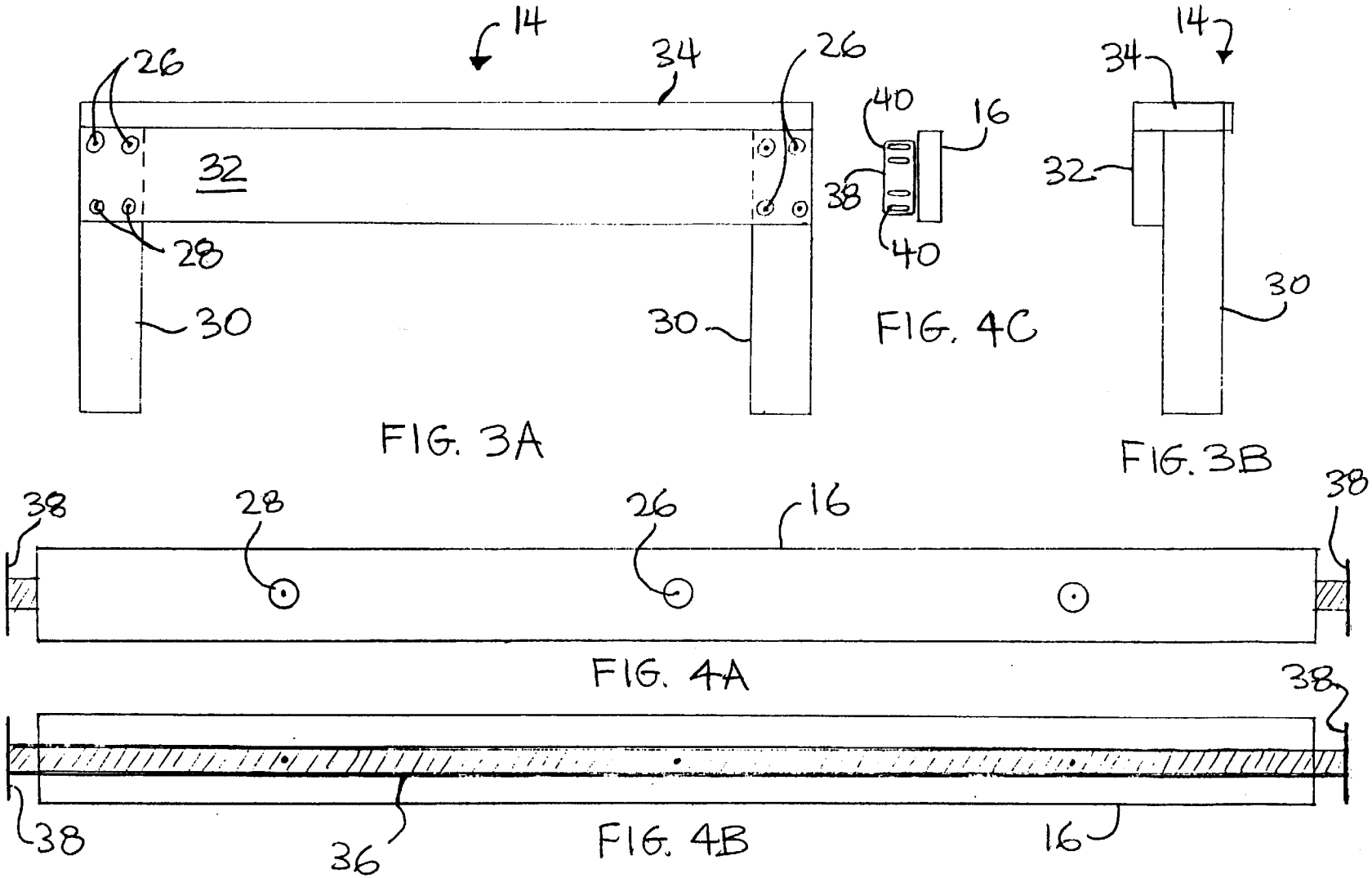
FIG. 3A is a front elevation view of the footboard of the bed frame of FIG. 1.
FIG. 3B is a side or end elevation view of the footboard of FIG. 3A.
FIG. 4A is a front elevation view of the sideboard and bed rail of the bed frame of FIG. 1.
FIG. 4B is a rear elevation view of the sideboard and bed rail of FIG. 4A.
FIG. 4C is an end view of the sideboard and bed rail of FIG. 4B.

Footboard 14 is seen in front elevation view in FIG. 3A and in side view in FIG. 3B. As seen in FIG. 3A, footboard 14 includes two spaced footboard corner posts 30. Corner posts 30 are connected by a footboard cross member 32. The top of footboard 14 is advantageously provided with a horizontally disposed dressing bench 34, on which a person may sit to facilitate putting on socks and shoes, for example. Footboard cross member 32 is fastened to corner posts 30 by bolts 26 fitted within recessed holes 28 in cross member 32.

Sideboard 16 is seen in front side view in FIG. 4A and in rear side view in FIG. 4B. A steel, angle-iron bed rail 36 of generally L-shaped cross-sectional shape is bolted to the rear or inside surface of sideboard 16. Bolt holes 28 in sideboards 16 are recessed for receiving the nuts on bolts 26. Steel brackets 38 are formed or attached on the opposite ends of bed rails 36 for attaching sideboards 16 to headboard 12 and to footboard 14. As seen in FIG. 4C, brackets 38 are provided with slotted holes 40 for receiving respective vertically aligned bolts 26 in headboard 12 and footboard 14. When assembling bed frame 10 for a narrower mattress or box spring (typically 38 inches wide), bed rails 36 are attached to the innermost pairs of bolts 26 in headboard 12 and footboard 14. Conversely, when assembling bed frame 10 for a wider mattress or box spring (typically 42 inches wide), bed rails 36 are attached to the outermost pairs of bolts 26 in headboard 12 and footboard 14. The present invention can advantageously adapt to accommodate commercially available bed mattresses and box springs of widths varying between 38 and 42 inches.

As seen in FIG. 1, bed frame 10 includes a pair of diagonally crossing wires 42. The ends of wires 42 are inserted into holes in bed rails 36. Wires 42 advantageously maintain bed rails 36 parallel and at a uniform distance apart. Wires 42 also automatically equalize and absorb the gravitational forces due to the weight of the bed exerted at any point within the plane of the bed rail structure so as to evenly distribute the bed load over bed frame 10. In one embodiment of the invention, slats 44 are placed over crossing wires 42. The ends of slats 44 are supported by bed rails 36. Slats 44 provide a solid, uniform base for the box spring or mattress (not illustrated) used in bed frame 10.

In an example embodiment of the invention, headboard 12, footboard 14, and sideboards 16 comprise smooth-cut, unfinished Western red cedar lumber. The wood is deliberately left unfinished so as to expose to the bedroom the aromatic oils in the cedar for the purpose of repelling insects away from the bed and its occupant.

In an example embodiment of bed frame 10 of the invention, corner posts 18 and 30 comprise 4 inch square wood posts. Headboard cross members 20, footboard cross members 32, sideboards 16, shelf 24, and dressing bench 34 comprise 2 inch by 6 inch wood boards. Bed rail 36 comprises steel angle-iron. Bolts 26 comprise grade 5, fine thread, ⅜ inch diameter steel bolts.

Although a twin size bed frame has been described and illustrated herein, bed frame 10 of the present invention may advantageously also be constructed to accommodate full-size, queen-size, or king-size commercially available mattresses by simply proportionately increasing the lengths of cross members 20 and 32, shelf 24, and dressing bench 34. The bed frame of the present invention is advantageously easily constructed from commercially available lumber and hardware. It can be quickly and easily hand assembled with only a wrench, socket, and ratchet hand tools.

Figure 5:
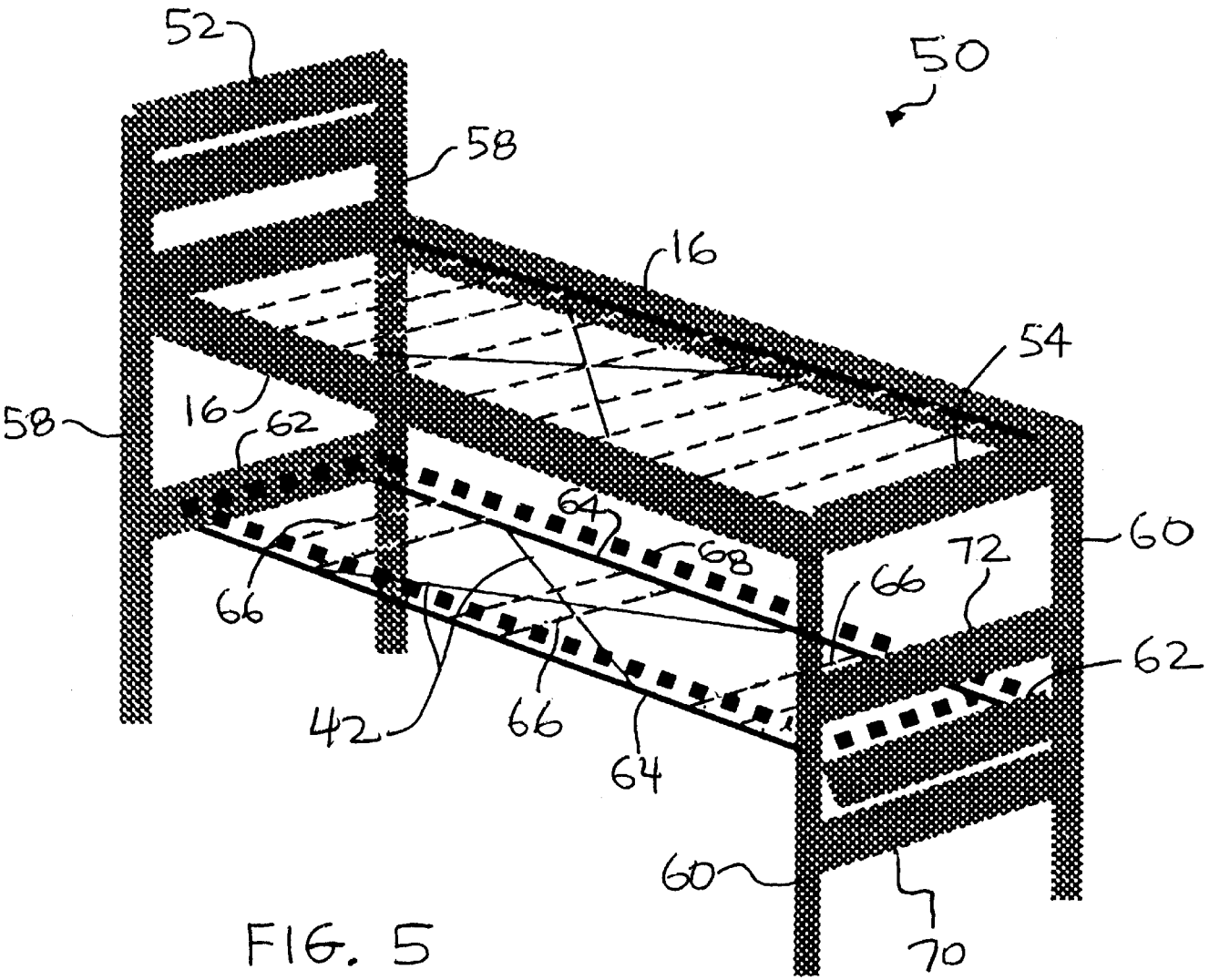
FIG. 5 is a perspective view of a combined bed and desk frame of the present invention.

FIG. 5 illustrates a combination bed and desk frame, generally designated 50, according to a second embodiment of the present invention. Like bed frame 10 of FIG. 1, bed/desk frame 50 includes headboard 52, footboard 54, and two sideboards 16. However, the corner posts 58 and 60 of headboard 52 and footboard 54, respectively, are extended longer than corner posts 18 and 30 of bed frame 10. As seen in FIG. 5, additional cross members 62 are fastened between headboard corner posts 58 and footboard corner posts 60 near their bottoms. The tops of cross members 62 are approximately 30 inches from the floor surface. In one embodiment, cross members 62 are bolted to corner posts 58 and 60 in a manner similar to that described above with respect to bed frame 10 and FIGS. 2A and 3A. A lower pair of spaced apart bed rails 64 are fastened between cross members 62. In one embodiment, bed rails 64 include brackets (not illustrated) on their ends for facilitating bolting to cross members 62 as described above with respect to frame 10.

Diagonally crossing wires 42 are fastened between bed rails 64 as described above with respect to bed frame 10. In one example embodiment, three slats 66 are placed over crossing wires 42. The ends of slats 66 are supported by bed rails 64. One slat 66 is placed near the middle of bed rails 64, and the other two are placed near their opposite ends, as seen in FIG. 5. A wood or steel door 68 readily commercially available from building supply stores and lumber yards is then placed directly on top of slats 66 and between bed rails 64. Door 68 forms a desk top when so used. Together, bed rails 64 and slats 66 form a secure encasement or receptacle for retaining door 68 in place and for preventing any lateral sliding movement of door 68 within bed/desk frame 50.

Wood and steel doors suitable for use as desk tops in bed/desk frame 50 are widely commercially available in a length of 80 inches, a thickness of 1 inch, and in widths of 32 or 36 inches. In one embodiment, the bolt holes for attaching bed rails 64 are predrilled in cross members 62 at multiple alternative locations so that bed rails 64 may be spaced and installed so as to accommodate different width doors. The weight and low position of door 68 and its supporting members lowers the center of gravity of bed/desk frame 50, thereby increasing the overall stability of bed/desk frame 50.

Footboard 54 is provided with ladder rungs 70 and 72 for permitting a user to climb up to the bed portion of bed/desk frame 50. In one embodiment, the tops of ladder rungs 70 and 72 are 20 inches and 40 inches, respectively, above the floor.

Figure 6:
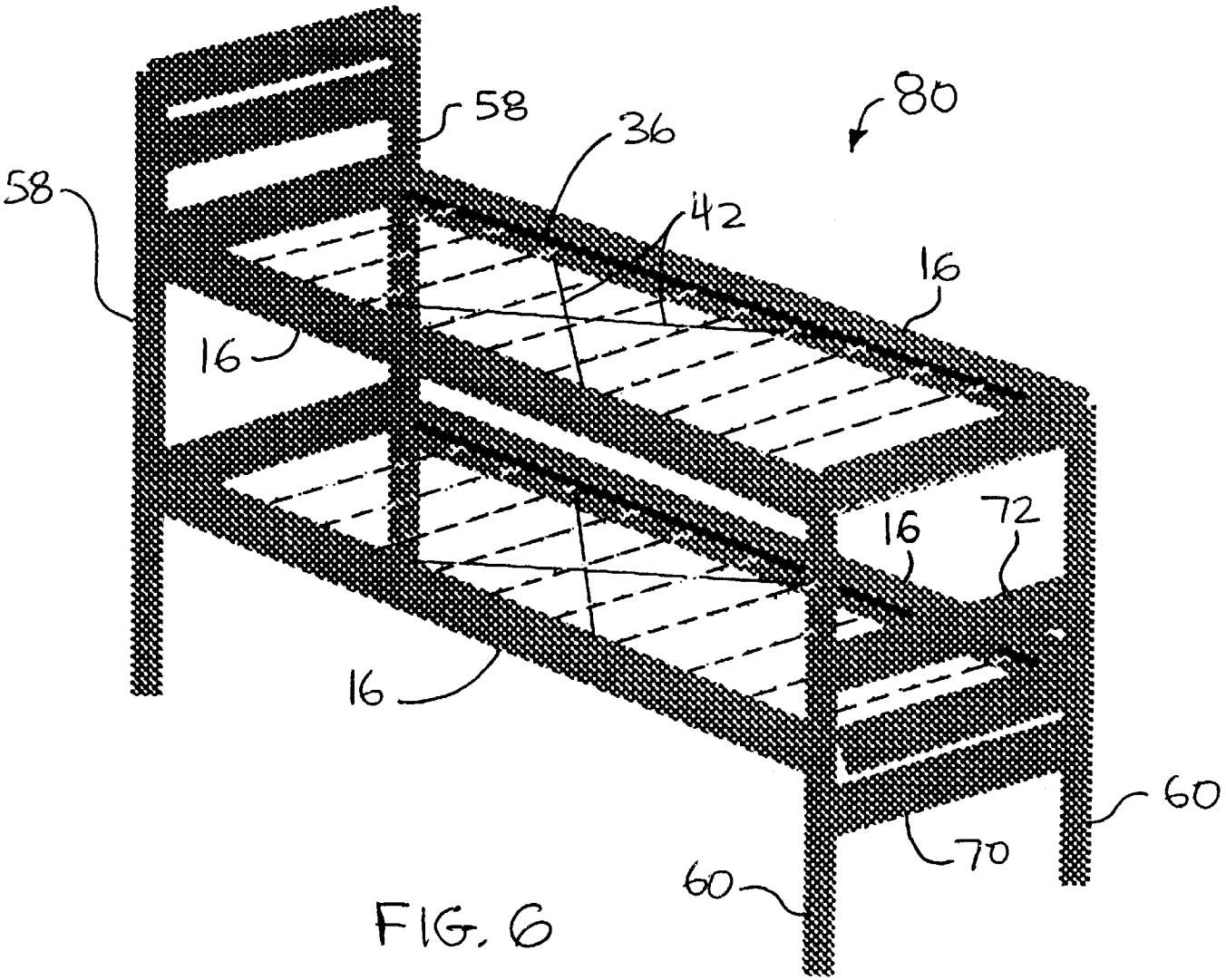
FIG. 6 is a perspective view of a bunk bed frame of the present invention.

FIG. 6 illustrates a bunk bed frame, generally designated 80, according to a third embodiment of the invention. Like bed/desk frame 50 of FIG. 5, bunk bed 80 has extended corner posts 58 and 60, as well as ladder rungs 70 and 72. However, bunk bed 80 has identical upper and lower sets of sideboards 16 and attached bed rails 36 for supporting upper and lower bed mattresses (not shown). The two bed frames of bunk bed 80 are each constructed as described above with respect to bed frame 10 of FIGS. 1–4. Therefore, their details will not be repeated here.

The bed frame assembly of the present invention, and many of its intended advantages, will be understood from the foregoing description of example embodiments, and it will be apparent that, although the invention and its advantages have been described in detail, various changes, substitutions, and alterations may be made in the manner, procedure, and details thereof without departing from the spirit and scope of the invention, as defined by the appended claims, or sacrificing any of its material advantages, the forms hereinbefore described being merely exemplary embodiments thereof claims

I claim:

1. A bed and desk frame, comprising:

a pair of spaced sideboards, the sideboards having first and second apposite ends;

a headboard attached to the first ends of the sideboards;

a footboard attached to the second ends of the sideboards;

a desk extending between the headboard and the footboard;

a pair of spaced corner posts with at least one cross member fastened between the corner post;

a pair of spaced rails extending between and fastened to the cross members of the headboard and the footboard wherein the rails support edges of the desk; and diagonally crossing wires fastened between the spaced rails for maintaining the rails in a parallel relationship and for evenly distributing the desk load over the bed and desk frame.

2. The bed and desk frame of claim 1, further including a plurality of slats arranged between and supported by the rails, and wherein the slats support the bottom of the desk.

3. The bed and desk frame of claim 1, wherein the desk comprises a standard building door.

4. The bed and desk frame of claim 1, wherein the sideboards, the headboard, and the footboard support a bed over the desk.

5. The bed and desk frame of claim 4, further including ladder rungs attached to one of the headboard and the footboard for permitting a user to climb the bed and desk frame in order to access the bed.

6. The bed and desk frame of claim 1, wherein at least one of the headboard, the footboard, and the sideboards comprise unfinished Western cedar lumber.

* * * * *